US009093752B2

(12) United States Patent
Yarga et al.

(10) Patent No.: US 9,093,752 B2
(45) Date of Patent: Jul. 28, 2015

(54) ELECTRONIC DEVICE WITH CAPACITIVELY LOADED ANTENNA

(71) Applicant: Apple Inc., Cupertino, CA (US)

(72) Inventors: Salih Yarga, Sunnyvale, CA (US); Qingxiang Li, Mountain View, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 273 days.

(21) Appl. No.: 13/790,549

(22) Filed: Mar. 8, 2013

(65) Prior Publication Data

US 2014/0253392 A1 Sep. 11, 2014

(51) Int. Cl.

| | |
|---|---|
| ***H01Q 1/24*** | (2006.01) |
| ***H01Q 1/36*** | (2006.01) |
| ***H01Q 5/328*** | (2015.01) |
| ***H01Q 5/335*** | (2015.01) |
| ***H01Q 5/371*** | (2015.01) |

(52) U.S. Cl.
CPC ..... *H01Q 1/36* (2013.01); *H01Q 1/243* (2013.01); *H01Q 5/328* (2015.01); *H01Q 5/335* (2015.01); *H01Q 5/371* (2015.01)

(58) Field of Classification Search
CPC ..... H01Q 1/36; H01Q 1/243; H01Q 5/0058; H01Q 5/0041; H01Q 5/0037
USPC ..... 343/702, 700 MS, 749, 750, 752, 745
See application file for complete search history.

(56) References Cited

U.S. PATENT DOCUMENTS

| | | | | |
|---|---|---|---|---|
| 5,764,190 | A * | 6/1998 | Murch et al. | 343/702 |
| 6,639,564 | B2 * | 10/2003 | Johnson | 343/702 |
| 7,183,994 | B2 * | 2/2007 | Weigand | 343/795 |
| 7,671,804 | B2 | 3/2010 | Zhang et al. | |
| 8,432,322 | B2 | 4/2013 | Amm et al. | |
| 2001/0043159 | A1 * | 11/2001 | Masuda et al. | 343/700 MS |
| 2002/0149526 | A1 * | 10/2002 | Tran et al. | 343/702 |
| 2011/0012794 | A1 | 1/2011 | Schlub et al. | |
| 2011/0050509 | A1 | 3/2011 | Ayala Vazquez et al. | |
| 2012/0046002 | A1 | 2/2012 | Hill et al. | |
| 2012/0169543 | A1 | 7/2012 | Sharma et al. | |
| 2012/0214412 | A1 | 8/2012 | Schlub et al. | |
| 2012/0223865 | A1 | 9/2012 | Li et al. | |
| 2012/0223866 | A1 | 9/2012 | Ayala Vazquez et al. | |
| 2012/0262343 | A1 | 10/2012 | Radojkovic | |
| 2013/0038494 | A1 | 2/2013 | Kuonanoja | |
| 2013/0076573 | A1 * | 3/2013 | Rappoport et al. | 343/702 |

OTHER PUBLICATIONS

Yarga et al., U.S. Appl. No. 13/790,549, filed Mar. 8, 2013.
Jiang et al., U.S. Appl. No. 13/864,968, filed Apr. 17, 2013.
Schlub et al., U.S. Appl. No. 13/420,278, filed Mar. 14, 2012.
Zhu et al., U.S. Appl. No. 13/402,831, filed Feb. 22, 2012.

* cited by examiner

*Primary Examiner* — Hoanganh Le
(74) *Attorney, Agent, or Firm* — Treyz Law Group; G. Victor Treyz; Joseph F. Guihan

(57) ABSTRACT

An electronic device may have an antenna for providing coverage in wireless communications bands of interest such as a low frequency communications band, a middle frequency communications band, and a high frequency communications band. Slot structures in the antenna that might reduce efficiency in the high frequency communications band may be avoided by capacitively loading the antenna and omitting meandering paths in the antenna. A capacitor may be coupled between an antenna ground formed from a metal housing structure and an antenna resonating element having a curved shape that conforms to the shape of the edge of the electronic device. The capacitor may have interdigitated fingers and may be adjustable to tune the antenna. The antenna may transmit and receive radio-frequency signals through a display cover layer in a display and a dielectric antenna window portion of the housing.

14 Claims, 16 Drawing Sheets

ELECTRONIC DEVICE WITH CAPACITIVELY LOADED ANTENNA

BACKGROUND

This relates generally to electronic devices, and, more particularly, to antennas in electronic devices.

Electronic devices such as portable computers and handheld electronic devices are often provided with wireless communications capabilities. For example, electronic devices may have wireless communications circuitry to communicate using cellular telephone bands and to support communications with satellite navigation systems and wireless local area networks.

It can be difficult to incorporate antennas and other electrical components successfully into an electronic device. Some electronic devices are manufactured with small form factors, so space for components is limited. In many electronic devices, the presence of conductive structures can influence the performance of electronic components, further restricting potential mounting arrangements for components such as antennas.

It would therefore be desirable to be able to provide improved electronic device antennas.

SUMMARY

An electronic device may have an antenna for providing coverage in wireless communications bands of interest such as a low frequency communications band, a middle frequency communications band, and a high frequency communications band. Slot structures in the antenna that might reduce efficiency in the high frequency communications band may be avoided while maintain a compact antenna size by capacitively loading the antenna and omitting meandering paths in the antenna.

A capacitor may be coupled between an antenna ground formed from a metal housing structure and an antenna resonating element having a curved shape that conforms to the shape of the edge of the electronic device. The capacitor may have interdigitated fingers that are formed from a metal trace that forms the antenna resonating element. The capacitor may be an adjustable capacitor that includes multiple fixed capacitors and switching circuitry for configuring which capacitors are switched into use. Adjustments to the adjustable capacitor may be used to tune the antenna.

The electronic device may have a housing. A display may be mounted on a front portion of the housing. A rear surface of the housing may have metal housing walls that form part of the antenna ground. The display may be covered by a display cover layer. An interior surface of an inactive portion of the display cover layer may be coated with an opaque masking material. The antenna may transmit and receive radio-frequency signals through the opaque masking material on the display cover layer and may transmit and receive radio-frequency signals through a dielectric portion of the housing such as a plastic antenna window in the metal housing walls. Portions of the antenna may be used to form capacitive proximity sensor electrode structures.

Further features of the invention, its nature and various advantages will be more apparent from the accompanying drawings and the following detailed description of the preferred embodiments.

DETAILED DESCRIPTION

Figure 1:
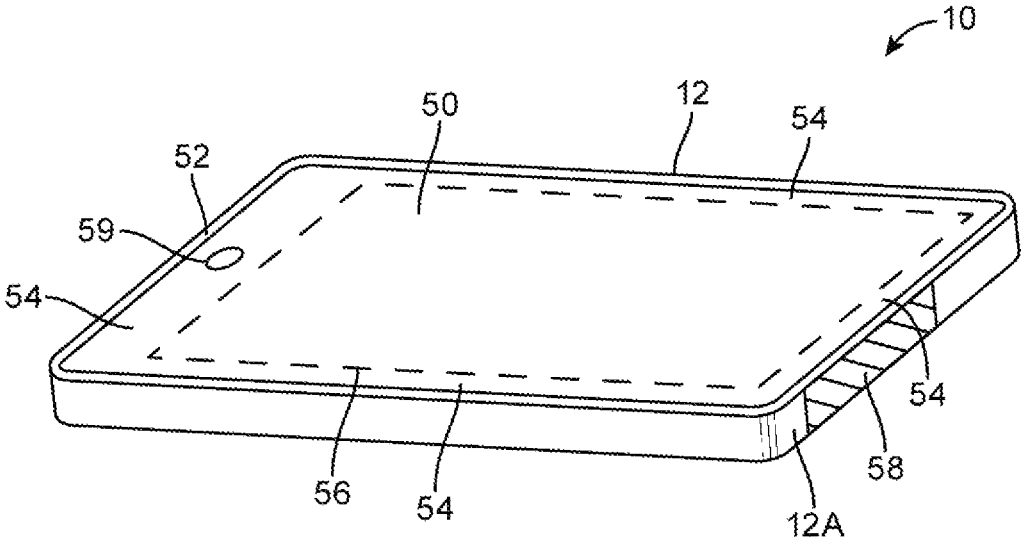
FIG. 1 is a front perspective view of an illustrative electronic device of the type that may be provided with antenna structures in accordance with an embodiment of the present invention.

Electronic devices may be provided with antennas, and other electronic components. An illustrative electronic device in which electronic components such as antenna structures may be used is shown in FIG. 1. As shown in FIG. 1, device 10 may have a display such as display 50. Display 50 may be mounted on a front (top) surface of device 10 or may be mounted elsewhere in device 10. Device 10 may have a housing such as housing 12. Housing 12 may have curved, angled, or vertical sidewall portions that form the edges of device 10 and a relatively planar portion that forms the rear surface of device 10 (as an example). Housing 12 may also have other shapes, if desired.

Housing 12 may be formed from conductive materials such as metal (e.g., aluminum, stainless steel, etc.), carbon-fiber composite material or other fiber-based composites, glass, ceramic, plastic, or other materials. A radio-frequency-transparent window such as window 58 may be formed in housing 12 (e.g., in a configuration in which the rest of housing 12 is formed from conductive structures). Window 58 may be formed from plastic, glass, ceramic, or other dielectric material. Antenna structures, and, if desired, proximity sensor structures for use in determining whether external objects are present in the vicinity of the antenna structures may be formed in the vicinity of window 58. If desired, antenna structures and proximity sensor structures may be mounted behind a dielectric portion of housing 12 (e.g., in a configuration in which housing 12 is formed from plastic or other dielectric material).

Device 10 may have user input-output devices such as button 59. Display 50 may be a touch screen display that is used in gathering user touch input. The surface of display 50 may be covered using a display cover layer such as a planar cover glass member or a clear layer of plastic. The central portion of display 50 (shown as region 56 in FIG. 1) may be an active region that displays images and that is sensitive to touch input. Peripheral portions of display 50 such as region 54 may form an inactive region that is free from touch sensor electrodes and that does not display images.

An opaque masking layer such as opaque ink or plastic may be placed on the underside of display 50 in peripheral region 54 (e.g., on the underside of the display cover layer). This layer may be transparent to radio-frequency signals. The conductive touch sensor electrodes and display pixel structures and other conductive structures in region 56 tend to block radio-frequency signals. However, radio-frequency signals may pass through the display cover layer (e.g., through a cover glass layer) and opaque masking layer in inactive display region 54 (as an example). Radio-frequency signals may also pass through antenna window 58 or dielectric housing walls in a housing formed from dielectric material. Lower-frequency electromagnetic fields may also pass through window 58 or other dielectric housing structures, so capacitance measurements for a proximity sensor may be made through antenna window 58 or other dielectric housing structures, if desired.

With one suitable arrangement, housing 12 may be formed from a metal such as aluminum. Portions of housing 12 in the vicinity of antenna window 58 may be used as antenna ground. Antenna window 58 may be formed from a dielectric material such as polycarbonate (PC), acrylonitrile butadiene styrene (ABS), a PC/ABS blend, or other plastics (as examples). Window 58 may be attached to housing 12 using adhesive, fasteners, or other suitable attachment mechanisms. To ensure that device 10 has an attractive appearance, it may be desirable to form window 58 so that the exterior surfaces of window 58 conform to the edge profile exhibited by housing 12 in other portions of device 10. For example, if housing 12 has straight edges 12A and a flat bottom surface, window 58 may be formed with a right-angle bend and vertical sidewalls. If housing 12 has curved edges 12A, window 58 may have a similarly curved exterior surface along the edge of device 10.

Figure 2:
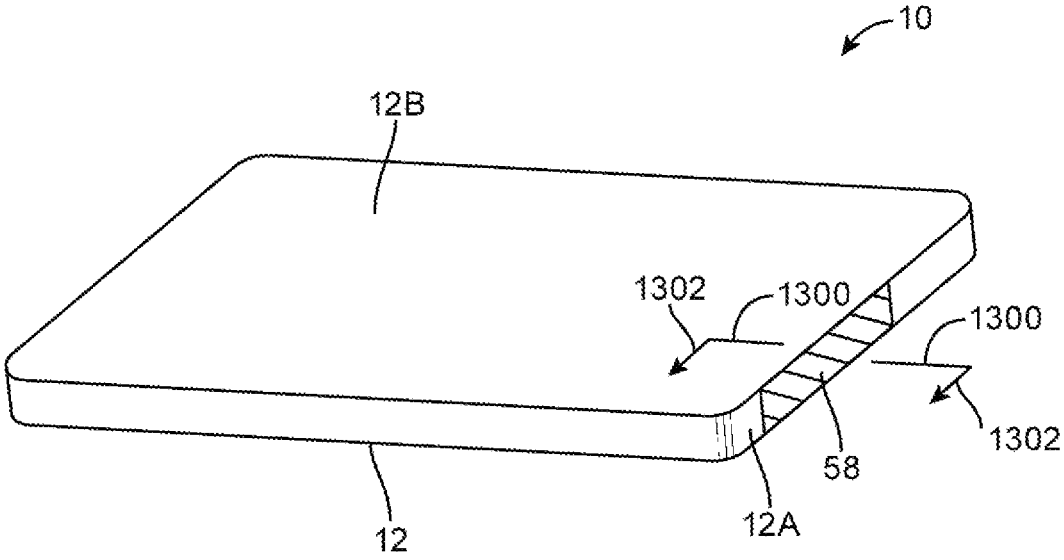
FIG. 2 is a rear perspective view of an illustrative electronic device such as the electronic device of FIG. 1 in accordance with an embodiment of the present invention.

FIG. 2 is a rear perspective view of device 10 of FIG. 1 showing how device 10 may have a relatively planar rear surface 12B and showing how antenna window 58 may be rectangular in shape with portions that match the shape of housing edges 12A. Antenna window 58 may have curved walls, planar walls, or walls of other shapes, if desired. Display 50 may be mounted on the opposing front surface of housing 12 of device 10.

Figure 3:
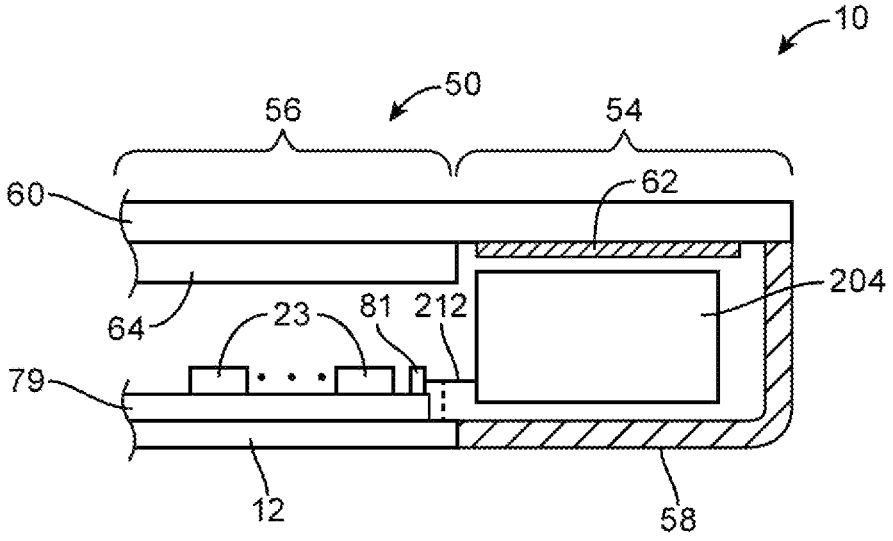
FIG. 3 is a cross-sectional side view of a portion of an electronic device having antenna structures in accordance with an embodiment of the present invention.

A cross-sectional view of device 10 taken along line 1300 of FIG. 2 and viewed in direction 1302 is shown in FIG. 3. As shown in FIG. 3, antenna structures 204 may be mounted within device 10 in the vicinity of antenna window 58. Structures 204 may include conductive material that serves as an antenna resonating element for an antenna. The antenna may be fed using transmission line 212. Transmission line 212 may have a positive signal conductor that is coupled to a positive antenna feed terminal (e.g., a feed terminal associated with a metal antenna resonating element trace on a dielectric support in structures 204) and a ground signal conductor that is coupled to a ground antenna feed terminal (i.e., antenna ground formed from conductive ground traces on a dielectric carrier in antenna structures 204 and/or grounded structures such as grounded portions of housing 12).

The antenna resonating element formed from structures 204 may be based on any suitable antenna resonating element design (e.g., structures 204 may form a patch antenna resonating element, a single arm inverted-F antenna structure, a dual-arm inverted-F antenna structure, other suitable multi-arm or single arm inverted-F antenna structures, a closed and/or open slot antenna structure, a loop antenna structure, a monopole, a dipole, a planar inverted-F antenna structure, a hybrid of any two or more of these designs, etc.). Configurations in which antenna structures 204 form a capacitively loaded inverted-F antenna are sometimes described herein as an example.

Housing 12 may serve as antenna ground for an antenna formed from structure 204 and/or other conductive structures within device 10 and antenna structures 204 may serve as ground (e.g., conductive components, traces on printed circuits, etc.).

Structures 204 may include patterned conductive structures such as patterned metal structures. The patterned conductive structures may, if desired, be supported by a dielectric carrier. The conductive structures may be formed from a coating, from metal traces on a flexible printed circuit, or from metal traces formed on a plastic carrier using laser-processing techniques or other patterning techniques. Structures 204 may also be formed from stamped metal foil or other metal structures. In configurations for antenna structures 204 that include a dielectric carrier, metal layers may be formed directly on the surface of the dielectric carrier and/or a flexible printed circuit that includes patterned metal traces may be attached to the surface of the dielectric carrier. If desired, conductive material in structures 204 may also form one or more proximity sensor capacitor electrodes.

During operation of the antenna formed from structures 204, radio-frequency antenna signals can be conveyed through dielectric window 58. Radio-frequency antenna signals associated with structures 204 may also be conveyed through a display cover member such as cover layer 60. Display cover layer 60 may be formed from one or more clear layers of glass, plastic, or other materials. Display 50 may have an active region such as region 56 in which cover layer 60 has underlying conductive structure such as display module 64. The structures in display module 64 such as touch sensor electrodes and active display pixel circuitry may be conductive and may therefore attenuate radio-frequency signals. In region 54, however, display 50 may be inactive (i.e., module 64 may be absent). An opaque masking layer such as plastic or ink 62 may be formed on the underside of transparent cover glass 60 in region 54 to block antenna structures 204 from view by a user of device 10. Opaque material 62 and the dielectric material of cover layer 60 in region 54 may be sufficiently transparent to radio-frequency signals that radio-frequency signals can be conveyed through these structures during operation of device 10.

Device 10 may include one or more internal electrical components such as components 23. Components 23 may include storage and processing circuitry such as microprocessors, digital signal processors, application specific integrated circuits, memory chips, and other control circuitry. Components 23 may be mounted on one or more substrates such as substrate 79 (e.g., rigid printed circuit boards such as boards formed from fiberglass-filled epoxy, flexible printed circuits, molded plastic substrates, etc.). Components 23 may include input-output circuitry such as sensor circuitry (e.g., capacitive proximity sensor circuitry), wireless circuitry such as radio-frequency transceiver circuitry (e.g., circuitry for cellular telephone communications, wireless local area network communications, satellite navigation system communications, near field communications, and other wireless communications), amplifier circuitry, and other circuits. Connectors such as connector 81 may be used in interconnecting circuitry 23 to communications paths such as transmission line path 212.

Conductive structures for antenna structures 204 may be supported by a dielectric carrier. Antenna structures 204 may, for example, have conductive structures such as metal structures that are supported by a hollow plastic member or other dielectric carrier. The conductive structures may be metal traces that are formed on the surface of a dielectric carrier using laser-based deposition techniques, physical vapor deposition techniques, electrochemical deposition, blanket metal deposition followed by photolithographic patterning, ink-jet printing deposition techniques, etc. The conductive structures may also be metal traces that are formed on a rigid printed circuit board (e.g., a printed circuit board formed from a substrate such as fiberglass-filled epoxy), metal traces that are formed on a flexible printed circuit (e.g., a printed circuit formed from a layer of polyimide or a sheet of other polymer) that is mounted on a dielectric carrier (e.g., a carrier formed from molded plastic or other material), may be other metal structures supported by a carrier (e.g., patterned metal foil), or may be other conductive structures.

Dielectric carriers for supporting metal antenna traces or a flexible printed circuit or other structure that includes metal antenna traces may be formed from a dielectric material such as glass, ceramic, or plastic. As an example, a dielectric carrier for antenna(s) in device 10 may be formed from plastic parts that are molded and/or machined into a desired shape such as a rectangular prism shape (rectangular box shape), a three-dimensional solid shape with one or more curved surfaces (e.g., a box shape with a curved outer surface that matches a corresponding curved housing edge 12A, or other shapes. In general, dielectric carrier shapes such as box or prism shapes with different numbers of sides and/or one or more curved surfaces or other three-dimensional carrier shapes may be used for antenna structures 204. The illustrative configuration of FIG. 3 in which antenna structures 204 have a rectangular cross-sectional shape is merely illustrative.

Figure 4:
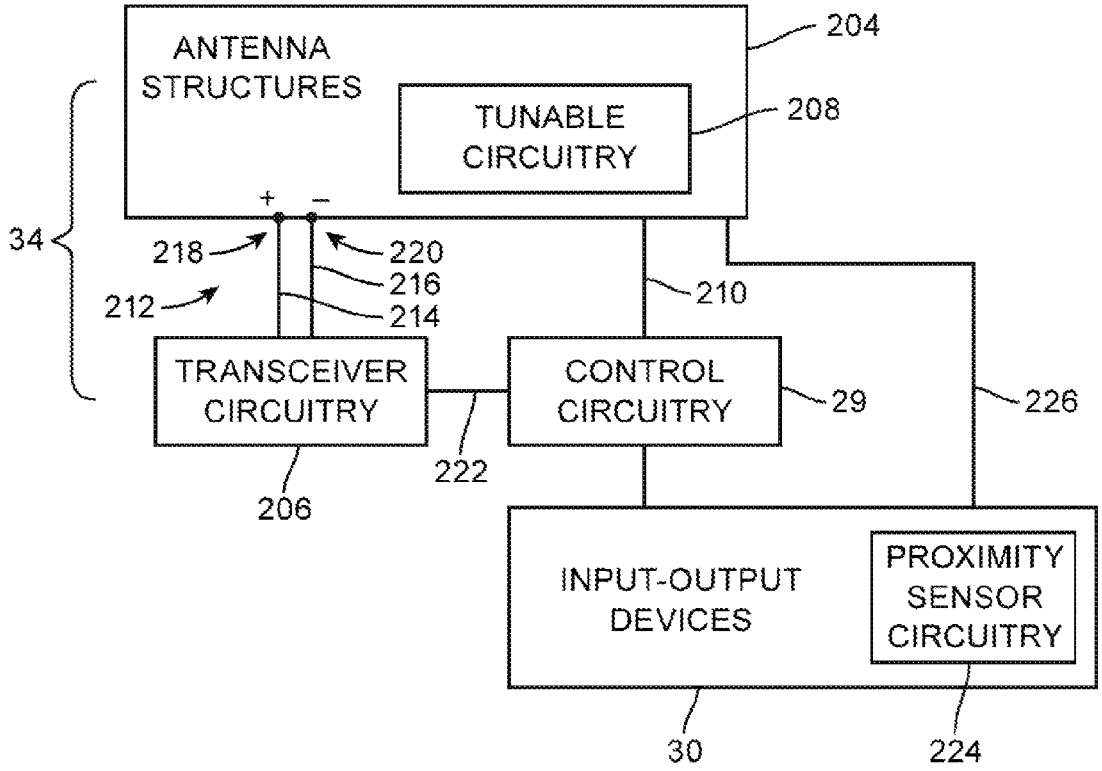
FIG. 4 is a diagram of illustrative antenna structures and other wireless circuitry in accordance with an embodiment of the present invention.

A schematic diagram of an illustrative configuration that may be used for electronic device 10 is shown in FIG. 4. As shown in FIG. 4, electronic device 10 may include control circuitry 29. Control circuitry 29 may include storage and processing circuitry for controlling the operation of device 10. Control circuitry 29 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 29 may include processing circuitry based on one or more microprocessors, microcontrollers, digital signal processors, baseband processors, power management units, audio codec chips, application specific integrated circuits, etc.

Control circuitry 29 may be used to run software on device 10, such as operating system software and application software. Using this software, control circuitry 29 may, for example, transmit and receive wireless data, tune antennas to cover communications bands of interest, and perform other functions related to the operation of device 10.

Input-output devices 30 may be used to allow data to be supplied to device 10 and to allow data to be provided from device 10 to external devices. Input-output circuitry 30 may include communications circuitry such as wired communications circuitry. Device 10 may also use wireless circuitry such as transceiver circuitry 206 and antenna structures 204 to communicate over one or more wireless communications bands.

Input-output devices 30 may also include input-output components with which a user can control the operation of device 10. A user may, for example, supply commands through input-output devices 30 and may receive status information and other output from device 10 using the output resources of input-output devices 30.

Input-output devices 30 may include proximity sensor circuitry 224 such as capacitive proximity sensor circuitry that uses portions of antenna structures 204 or other conductive structures in device 10 as capacitive proximity sensor electrodes. Proximity sensor circuitry 224 may be coupled to proximity sensor electrode structures in antenna structures 204 or elsewhere in device 10 using paths such as path 226. A capacitive proximity sensor may, for example, be used to determine when a user's body or other external object is in the vicinity of antenna structures 204. Proximity sensors for device 10 may also be formed using light-based proximity sensor structures, acoustic proximity sensor structures, etc.

Input-output devices 10 may also include sensors and status indicators such as an ambient light sensor, a temperature sensor, a pressure sensor, a magnetic sensor, an accelerometer, and light-emitting diodes and other components for gathering information about the environment in which device 10 is operating and providing information to a user of device 10 about the status of device 10. Audio components in devices 30 may include speakers and tone generators for presenting sound to a user of device 10 and microphones for gathering user audio input.

Devices 30 may include one or more displays such as display 50 of FIG. 1. Displays may be used to present images for a user such as text, video, and still images. Sensors in devices 30 may include a touch sensor array that is formed as one of the layers in display 14. During operation, user input may be gathered using buttons and other input-output components in devices 30 such as touch pad sensors, buttons, joysticks, click wheels, scrolling wheels, touch sensors such as a touch sensor array in a touch screen display or a touch pad, key pads, keyboards, vibrators, cameras, and other input-output components.

Wireless communications circuitry 34 may include radio-frequency (RF) transceiver circuitry such as transceiver circuitry 206 that is formed from one or more integrated circuits, power amplifier circuitry, low-noise input amplifiers, passive RF components, one or more antennas such as antenna structures 204, and other circuitry for handling RF wireless signals. Wireless signals can also be sent using light (e.g., using infrared communications).

Wireless communications circuitry 34 may include radio-frequency transceiver circuits for handling multiple radio-frequency communications bands. For example, circuitry 34 may include transceiver circuitry 206 for handling cellular telephone communications, wireless local area network signals, and satellite navigation system signals such as signals at 1575 MHz from satellites associated with the Global Positioning System. Transceiver circuitry 206 may handle 2.4 GHz and 5 GHz bands for WiFi® (IEEE 802.11) communications or other wireless local area network communications and may handle the 2.4 GHz Bluetooth® communications band. Circuitry 206 may use cellular telephone transceiver circuitry for handling wireless communications in cellular telephone bands such as the bands in the range of 700 MHz to 2.7 GHz (as examples).

Wireless communications circuitry 34 can include circuitry for other short-range and long-range wireless links if desired. For example, wireless communications circuitry 34 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles. Wireless communications circuitry 34 may also include circuitry for handing near field communications.

Wireless communications circuitry 34 may include antenna structures 204. Antenna structures 204 may include one or more antennas. Antenna structures 204 may include inverted-F antennas, patch antennas, loop antennas, monopoles, dipoles, single-band antennas, dual-band antennas, antennas that cover more than two bands, or other suitable antennas. Configurations in which at least one antenna in device 10 is formed from an inverted-F antenna structure such as a capacitively loaded dual band inverted-F antenna are sometimes described herein as an example.

To provide antenna structures 204 with the ability to cover communications frequencies of interest, antenna structures 204 may be provided with one or more tunable components or other tunable circuitry. Discrete components such as capacitors, inductors, and resistors may be incorporated into the tunable circuitry. Capacitive structures, inductive structures, and resistive structures may also be formed from patterned metal structures (e.g., part of an antenna).

If desired, antenna structures 204 may be provided with adjustable circuits such as tunable circuitry 208 of FIG. 4. Tunable circuitry 208 may be controlled by control signals from control circuitry 29. For example, control circuitry 29 may supply control signals to tunable circuitry 208 via control path 210 during operation of device 10 whenever it is desired to tune antenna structures 204 to cover a desired communications band. Path 222 may be used to convey data between control circuitry 29 and wireless communications circuitry 34 (e.g., when transmitting wireless data or when receiving and processing wireless data).

A fixed or adjustable component such as a capacitor (e.g., a fixed capacitor coupled to antenna structures 204 and/or a tunable capacitor in tunable circuitry 208) may be used to help antenna structures 204 exhibit antenna resonances in communications bands of interest with desired antenna efficiencies.

Transceiver circuitry 206 may be coupled to antenna structures 204 by signal paths such as signal path 212. Signal path 212 may include one or more transmission lines. As an example, signal path 212 of FIG. 4 may be a transmission line having a positive signal conductor such as line 214 and a ground signal conductor such as line 216. Lines 214 and 216 may form parts of a coaxial cable or a microstrip transmission line (as examples). A matching network formed from components such as inductors, resistors, and capacitors may be used in matching the impedance of antenna structures 204 to the impedance of transmission line 212. Matching network components may be provided as discrete components (e.g., surface mount technology components) or may be formed from housing structures, printed circuit board structures, traces on plastic supports, etc. Components such as these may also be used in forming fixed circuit elements such as a fixed capacitor coupled to an antenna resonating element trace in antenna structures 204 and/or a tunable element such as a tunable capacitor in tunable circuitry 208 in antenna structures 204.

Transmission line 212 may be coupled to antenna feed structures associated with antenna structures 204. As an example, antenna structures 204 may form an inverted-F antenna having an antenna feed with a positive antenna feed terminal such as terminal 218 and a ground antenna feed terminal such as ground antenna feed terminal 220. Positive transmission line conductor 214 may be coupled to positive antenna feed terminal 218 and ground transmission line conductor 216 may be coupled to ground antenna feed terminal 220. Other types of antenna feed arrangements may be used if desired. The illustrative feeding configuration of FIG. 4 is merely illustrative.

Tunable circuitry 208 may be formed from one or more tunable circuits such as circuits based on capacitors, resistors, inductors, and switches. Tunable circuitry 208 may be implemented using discrete components mounted to a printed circuit such as a rigid printed circuit board (e.g., a printed circuit board formed from glass-filled epoxy) or a flexible printed circuit formed from a sheet of polyimide or a layer of other flexible polymer, a plastic carrier, a glass carrier, a ceramic carrier, or other dielectric substrate. As an example, tunable circuitry 208 may be coupled to a dielectric carrier of the type that may be used in supporting antenna resonating element traces for antenna structures 204 (FIG. 3). Fixed circuit components (e.g., a fixed capacitor coupled to antenna structures 204) may also be formed using these arrangements.

Figure 5:
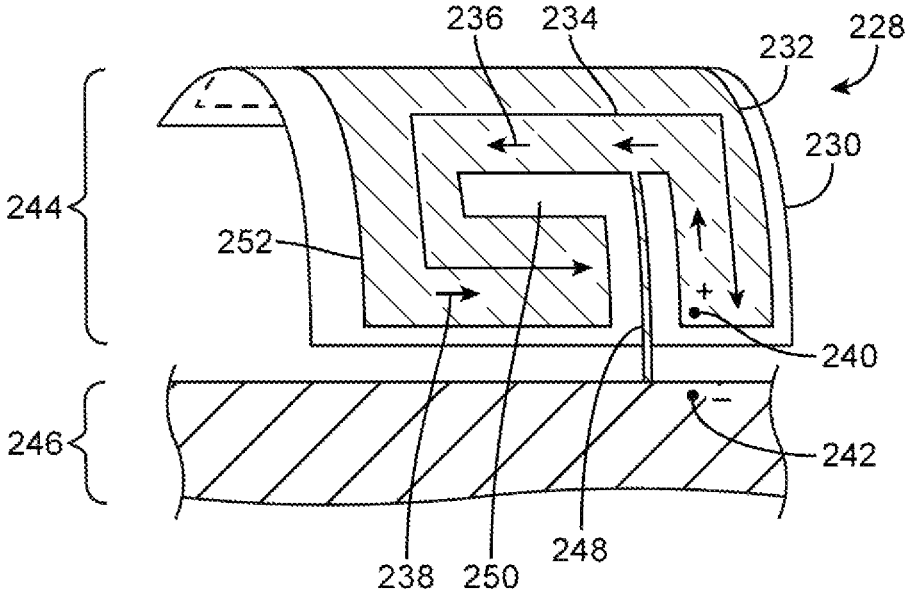
FIG. 5 is a perspective view of an antenna with a antenna resonating element having a meandering path that may be used in an electronic device in accordance with an embodiment of the present invention.

FIG. 5 is a diagram of an illustrative antenna of the type that may be used in an electronic device such as device 10. Antenna 228 has antenna resonating element 244 and antenna ground 246. Antenna resonating element 244 may be formed from antenna resonating element trace 232 on curved dielectric support 230. Antenna 228 may have an inverted-F configuration having main resonating element arm 252, short circuit path 248 to couple main resonating element arm 252 to antenna ground 246, and an antenna feed having positive antenna feed terminal 240 and ground antenna feed terminal 242.

Arm 252 may be characterized by length 234 (e.g., a length extending from the antenna feed formed from terminals 240 and 242 at one end of arm 252 to the opposing end of arm 252). A fundamental antenna resonant peak may be associated with a signal frequency where a quarter of a wavelength is equal to length 234. To help implement antenna 228 in a compact size, antenna resonating element arm 252 of FIG. 5 has a meandering path. The meandering layout of arm 252 in antenna resonating element trace 232 gives rise to opposing currents such as currents 236 and 238 in some modes of operation, which can reduce antenna efficiency. The meandering layout of arm 252 also gives rise to slot 250, which can exhibit undesired slot resonances (e.g., slot resonances where the length of the slot is equal to about a quarter of a wavelength).

Figure 6:
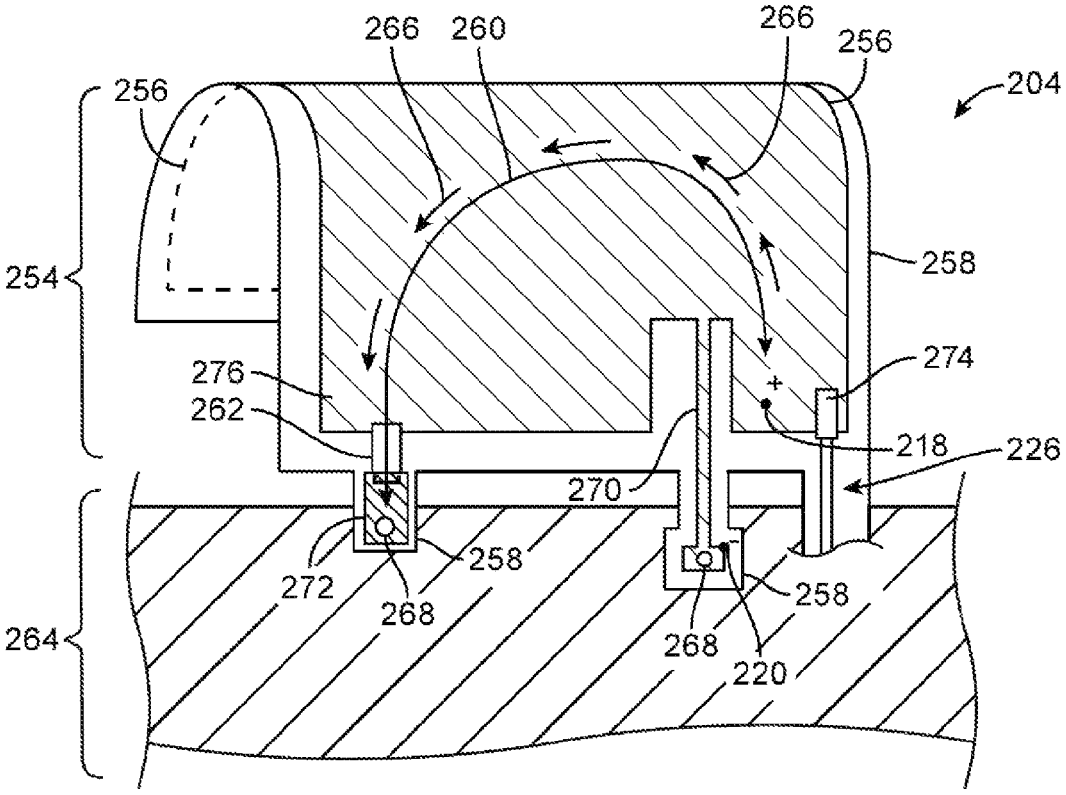
FIG. 6 is a perspective view of an antenna with a capacitively loaded antenna resonating element without a meandering path in accordance with an embodiment of the present invention.

An antenna design for device 10 that can be used to avoid the use of the meandering path configuration of FIG. 5 is shown in FIG. 6. Antenna 204 of FIG. 6 may have an inverted-F antenna resonating element such as antenna resonating element 254 and an antenna ground such as antenna ground 264. Antenna ground 264 may be formed from housing 12 and/or other conductive structures in device 10. Antenna resonating element 254 may have a main antenna resonating element arm formed from metal trace 256 on dielectric support 258 (e.g., a plastic carrier or a printed circuit mounted to a plastic carrier, etc.). Antenna 204 may be fed using an antenna feed that includes positive antenna feed terminal 218 coupled to trace 256 and ground antenna feed terminal 220 on antenna ground 264. The antenna feed may be located at one end of the main resonating element arm (e.g., the right-hand end in the orientation of FIG. 6). Capacitor 262 may be coupled to the opposing (left-hand) end of the resonating element arm. Short circuit path 270 may couple the main antenna resonating element arm to antenna ground 264 at a location between the antenna feed and capacitor 262 (as an example). An electrical connection such as a weld, solder joint, or screw 268 may be used in coupling short circuit path 270 to ground 264.

There may be one or more layers of metal traces 256 in antenna 204. If desired, proximity sensor circuitry 224 (FIG. 4) may be coupled to metal traces 256 via path 226 and isolating circuitry 274 (e.g., a pair of inductors for preventing radio-frequency antenna signals from antenna resonating element trace 256 from reaching circuitry 224 through a pair of respective signal lines in path 226).

Inverted-F antenna resonating element 254 may avoid the use of meandering paths of the type shown in FIG. 5, so antenna currents 266 may flow in antenna resonating element 254 without cancelling each other and without being subjected to undesired slot-based resonances. The layout of antenna resonating element 254 of FIG. 6 may thereby enhance antenna performance in desired communications bands.

Capacitor 262 (or other suitable coupling circuit) may couple tip portion 276 to antenna ground 264, thereby capacitively loading antenna 204. Capacitor 262 may be, for example, a surface mount technology component that exhibits a fixed or a tunable capacitance value. One terminal of capacitor 262 may be connected to portion 276 of metal trace 256. The other terminal of capacitor 262 may be coupled to trace segment 272, which is coupled to antenna ground 264 by electrical connections 268 (e.g., a weld, solder, a screw, or other fastener).

With a capacitively loaded inverted-F antenna resonating element configuration of the type shown in FIG. 6, antenna resonating element 254 may be characterized by electrical length 260. Length 260 may have a first portion based on the physical size of metal trace 256 and may have a second portion based on capacitive loading from capacitor 262. Because of the presence of capacitor 262, antenna 204 may be implemented in a compact size (e.g., approximately the same antenna volume as the antenna of FIG. 5) without using a meandering resonating element arm layout of the type shown in FIG. 5 and without including resonating slot structure 250 of FIG. 5.

Figure 7:
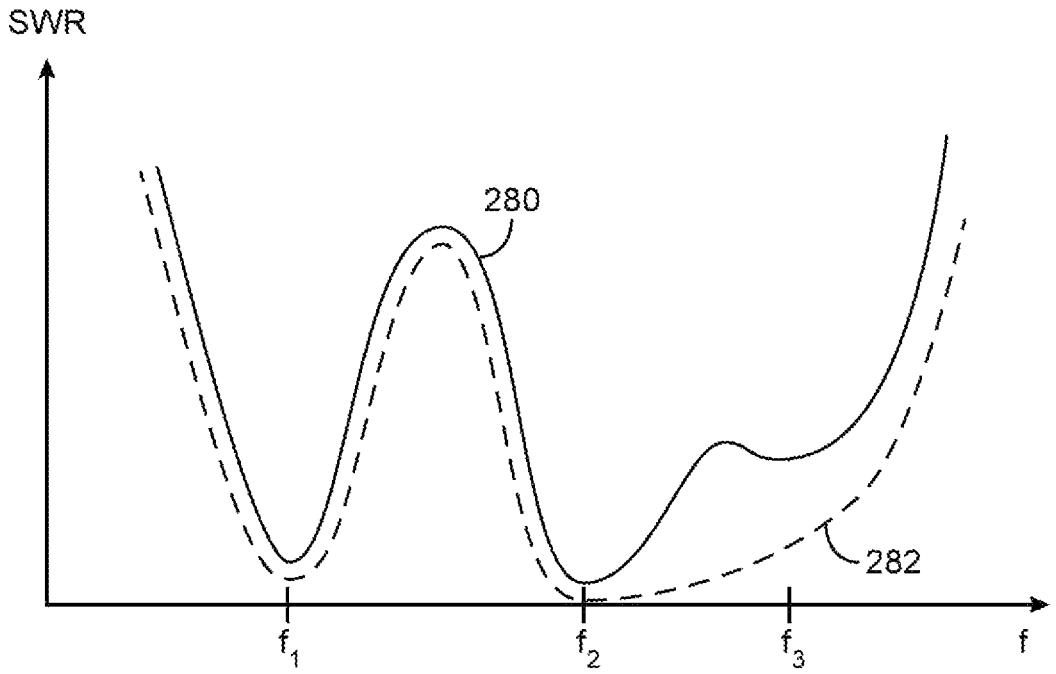
FIG. 7 is a graph in which antenna performance (standing-wave ratio) for antennas of the types shown in FIGS. 5 and 6 has been plotted as a function of operating frequency in accordance with an embodiment of the present invention.

FIG. 7 is a graph in which antenna performance (standing wave ratio SWR) has been plotted as a function of operating frequency for an antenna with a meandering path of the type shown in FIG. 5 (curve 280) and a capacitively loaded antenna of the type shown in FIG. 6 that has a main resonating element arm without meandering portions (curve 282). As shown in FIG. 7, in low frequency band f1 and middle frequency band f2, curves 280 and 282 may exhibit satisfactory performance. Performance for antenna 204 of FIG. 6 (curve 282) may be superior to performance for antenna 228 of FIG. 5, because antenna 204 does not generally experience nullification of antenna currents due to a meandering path. Antenna resonating element traces 256 may be relatively large due to the absence of slot 250, thereby enhancing the ability of traces 256 to serve as a capacitive proximity sensor electrode for a proximity sensor in device 10. The absence of slot 250 may also prevent undesired operation of antenna 204 in an inefficient slot antenna mode, thereby improving antenna performance at high frequency communications band f3 as illustrated by the separation between curves 280 and 282 at frequency band f3. With one illustrative configuration, communications bands f1, f2, and f3 may cover cellular bands and other antenna signals ranging from 700 MHz (bottom of band f1) to 2700 MHz (top of band f3).

Figure 8:
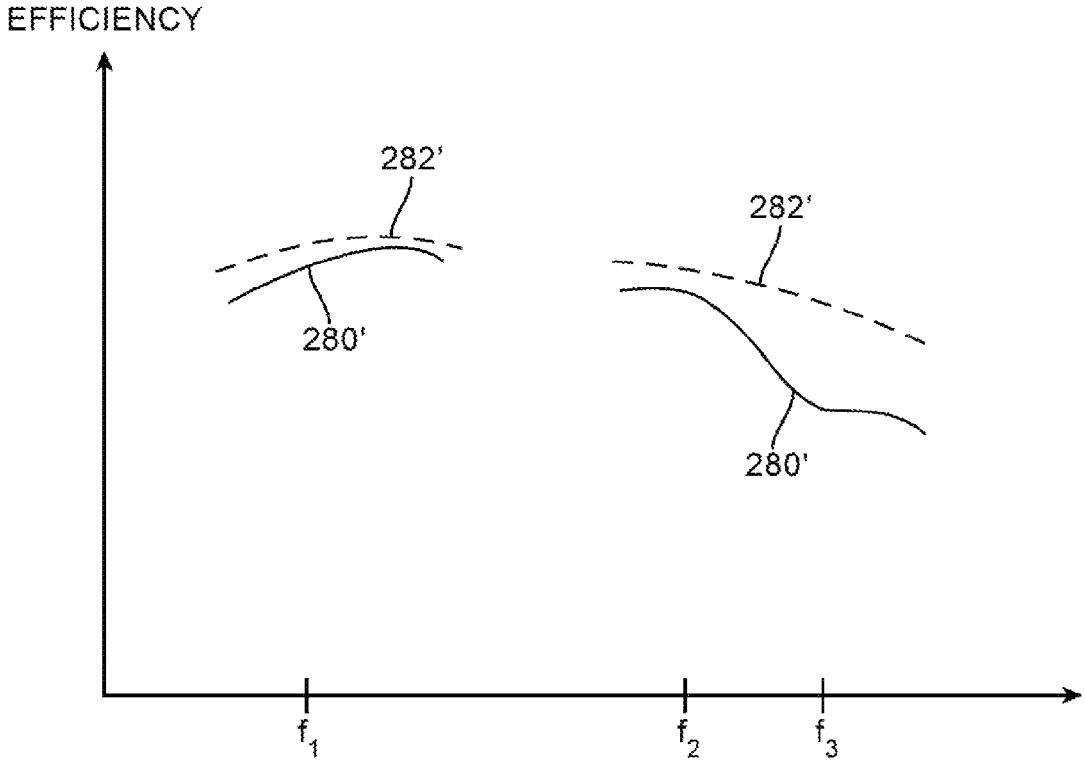
FIG. 8 is a graph in which antenna efficiency has been plotted as a function of operating frequency for antennas of the types shown in FIGS. 5 and 6 in accordance with an embodiment of the present invention.

In FIG. 8, antenna efficiency has been plotted as a function of operating frequency for an antenna with a meandering path of the type shown in FIG. 5 (curve 280') and a capacitively loaded antenna of the type shown in FIG. 6 that has a main resonating element arm without meandering portions (curve 282'). At operating frequencies associated with low frequency band f1 and middle frequency band f2, curves 280' and 282' may exhibit satisfactory efficiency. The efficiency of antenna 204 of FIG. 6 (curve 282') may be greater than the efficiency of antenna 228 of FIG. 5, because antenna 204 does not generally experience nullification of antenna currents due to a meandering path. The absence of slot 250 may also prevent undesired operation of antenna 204 in an inefficient slot antenna mode, thereby improving antenna performance at high frequency communications band f3, as illustrated by the greater efficiency of antenna 204 (curve 282') than the efficiency of meandering path antenna of FIG. 5 (curve 280').

Figure 9:
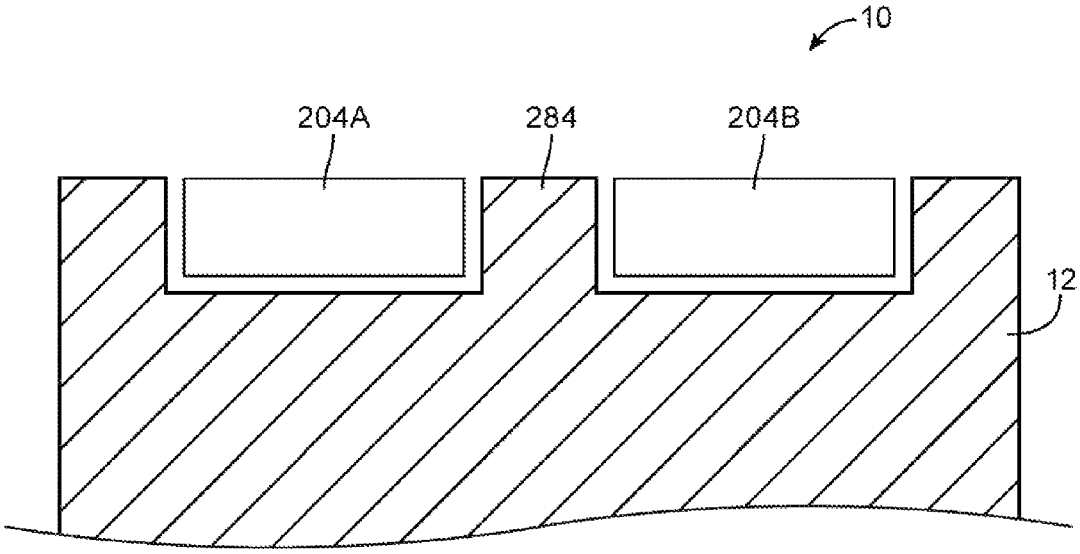
FIG. 9 is a top view of an edge portion of a illustrative electronic device of the type that may be provided with multiple capacitively loaded inverted-F antennas in accordance with an embodiment of the present invention.

FIG. 9 is a top view of an edge portion of device 10 showing how device 10 may be provided with multiple antennas such as antenna 204A and antenna 204B. Conductive structures 284 (e.g., metal housing structures, traces on printed circuit boards, antenna structures such as a Global Positioning System antenna, metal portions of device components such as a camera and other conductive structures) may be interposed between antennas 204A and 204B. Antennas 204A and 204B may each be an antenna of the type shown in FIG. 6. If desired, additional antennas such as antenna 204 of FIG. 6 may be mounted within device 10. The illustrative configuration of FIG. 9 in which device 10 has been provided with a pair of antennas 204 is merely illustrative.

Figure 10:
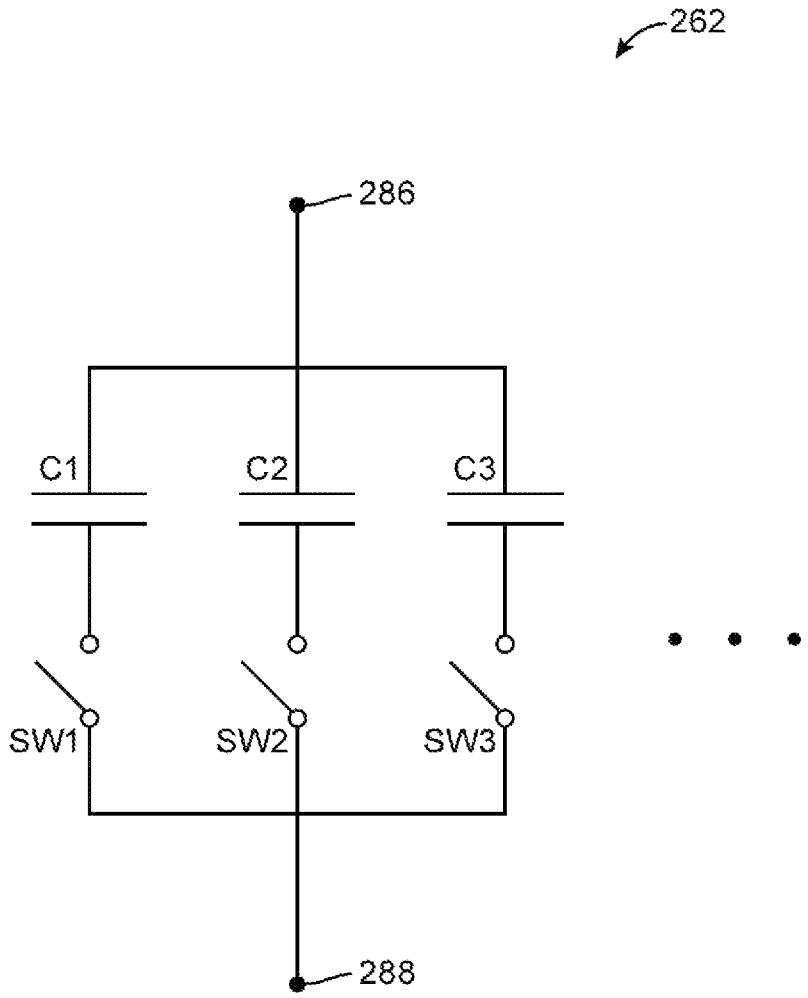
FIG. 10 is a circuit diagram of an illustrative tunable component based on multiple components such as capacitors and associated switches coupled in parallel between first and second terminals in accordance with an embodiment of the present invention.

Capacitor 262 of antenna 204 of FIG. 6 may be implemented using a fixed capacitor or an adjustable capacitor. FIG. 10 is a circuit diagram of an illustrative configuration that may be used for implementing capacitor 262 as an adjustable capacitor. Adjustable capacitor 262 of FIG. 10 has three fixed capacitors C1, C2, and C3 coupled respectively to three respective switches SW1, SW2, and SW3. The switches and respective fixed capacitors of FIG. 10 may be coupled in parallel between adjustable capacitor terminals 286 and 288.

Various capacitor values may be achieved by adjusting switches SW1, SW2, and SW3 using control signals from control circuitry 29. When switches SW1, SW2, and SW3 are all closed, the capacitance of capacitor 262 will be maximized (C1+C2+C3). When switches SW1, SW2, and SW3 are all open, the capacitance of capacitor 262 will be zero. Intermediate values of capacitance may be produced with other switch settings. For example, when one of the switches such as switch SW1 is closed while the other switches are opened, a single capacitor (e.g., capacitor C1) will be switched into use while the other capacitors (C2 and C3) will be switched out of use.

If desired, other numbers of fixed capacitors may be used in adjustable capacitor 262. The example of FIG. 10 in which three capacitors are selectively switched into or out of use by switching circuitry such as switches SW1, SW2, and SW3 is merely illustrative. In operation in antenna 204, terminal 286 of adjustable capacitor 262 may be coupled to portion 276 of metal trace 256 and terminal 288 of adjustable capacitor 262 may be coupled to metal structure 272 and antenna ground 264.

Figure 11:
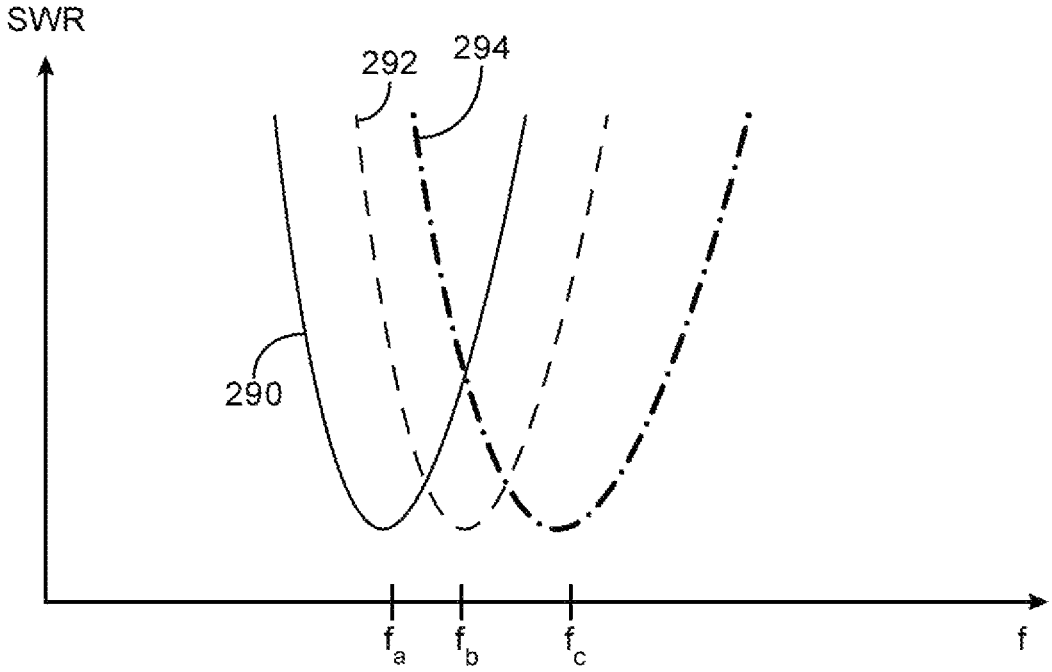
FIG. 11 is a graph in which antenna performance (standing wave ratio) has been plotted as a function of frequency for three corresponding settings of a tunable component such as a tunable capacitor in a capacitively loaded inverted-F antenna in accordance with an embodiment of the present invention.

FIG. 11 is a graph in which antenna performance (standing wave ratio SWR) for antenna 204 has been plotted in a given communications band (e.g., low band f1 or other suitable band) as a function of operating frequency. Adjustments to the capacitance exhibited by adjustable capacitor 262 will tune antenna 204 and thereby shift the position of the antenna resonance exhibited by antenna 204. In the FIG. 11 example, adjustable capacitor 262 has been adjusted between three different capacitance settings. Curve 290 corresponds to a first state of capacitor 262 in which capacitor 262 has been configured to exhibit a first capacitance value and antenna 204 therefore exhibits an antenna resonance centered on frequency fa. Curve 292 corresponds to a second state of capacitor 262 in which capacitor 262 has been configured to exhibit a second capacitance value that is different than the first capacitance value so that antenna 204 exhibits an antenna resonance centered on frequency fb. In the configuration of curve 294, adjustable capacitor 262 has a third capacitance value that differs from the first and second capacitance values so that antenna 204 exhibits an antenna resonance centered on frequency fc. By adjusting the value of capacitor 262 in this way, a desired range of operating frequencies (i.e., a desired communications bandwidth) may be covered by antenna 204.

Figure 12:
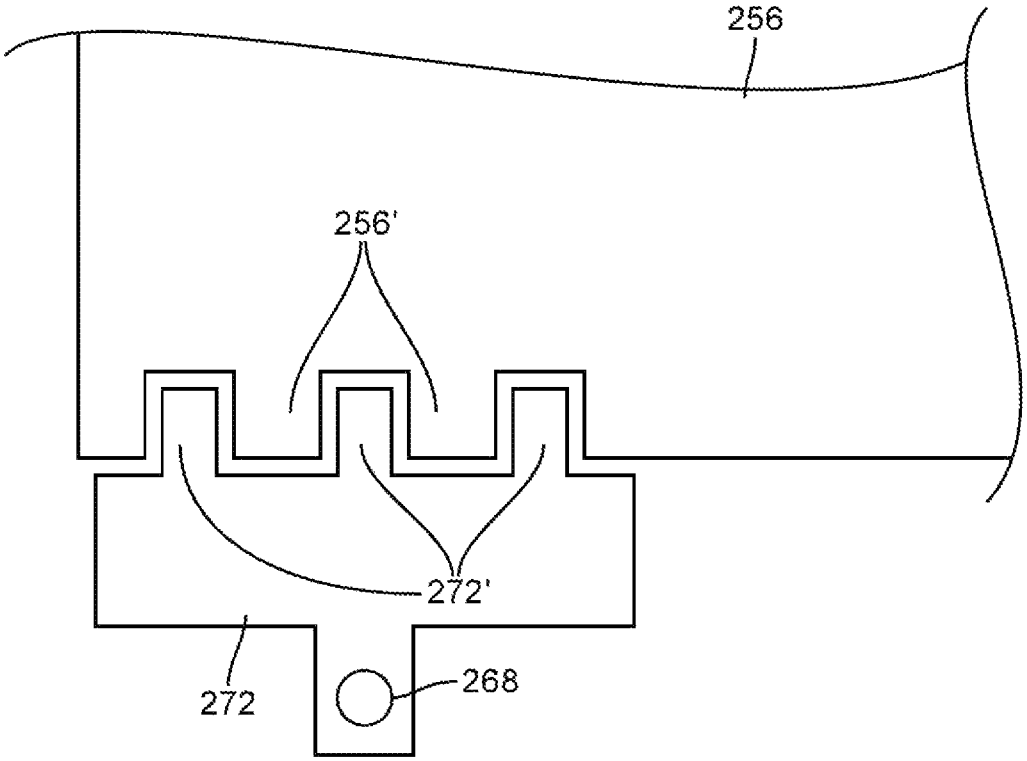
FIG. 12 is a diagram of a portion of a capacitively loaded inverted-F antenna having interdigitated capacitor fingers for forming a capacitor in accordance with an embodiment of the present invention.

It may be desirable to implement capacitor 262 using metal structures separated by a gap. The metal structures may be, for example, metal traces such as portions of metal trace 256 and 272 of FIG. 6. To enhance the amount of capacitance that is produced within a given volume, metal traces 256 and 272 may have interdigitated portions such as interdigitated fingers 256' and 272' of FIG. 12. The use of interdigitated structures may increase capacitance without significantly increasing the amount of space consumed by the adjustable capacitor.

Antenna 204 may be implemented using a curved flexible printed circuit substrate that is supported by a plastic carrier with a curved surface or other surface shape and/or using metal traces formed directly on the surface of a plastic carrier with a curved surface or other surface shape (e.g., metal traces deposited using electrochemical deposition techniques or other metal deposition techniques).

Figure 13:
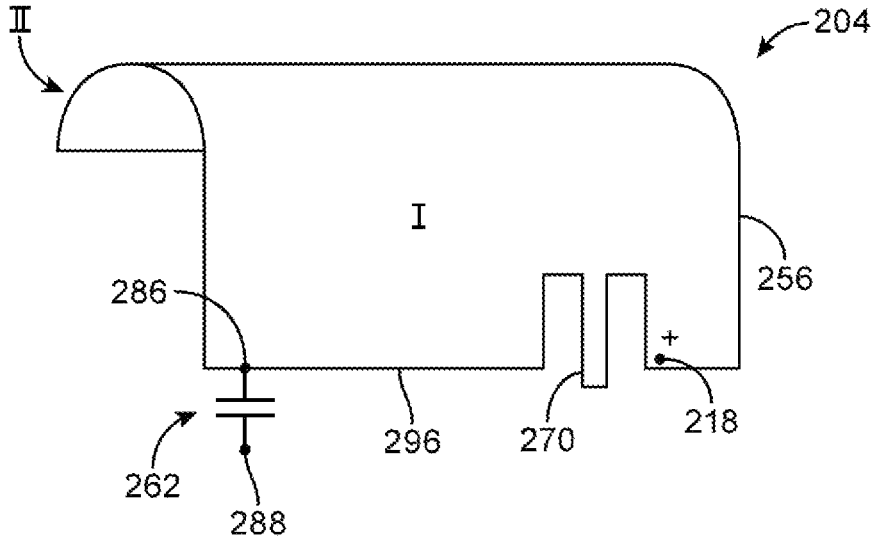
FIG. 13 is a perspective view of an illustrative capacitively loaded inverted-F antenna resonating element formed in a curved shape in accordance with an embodiment of the present invention.
Figure 14:
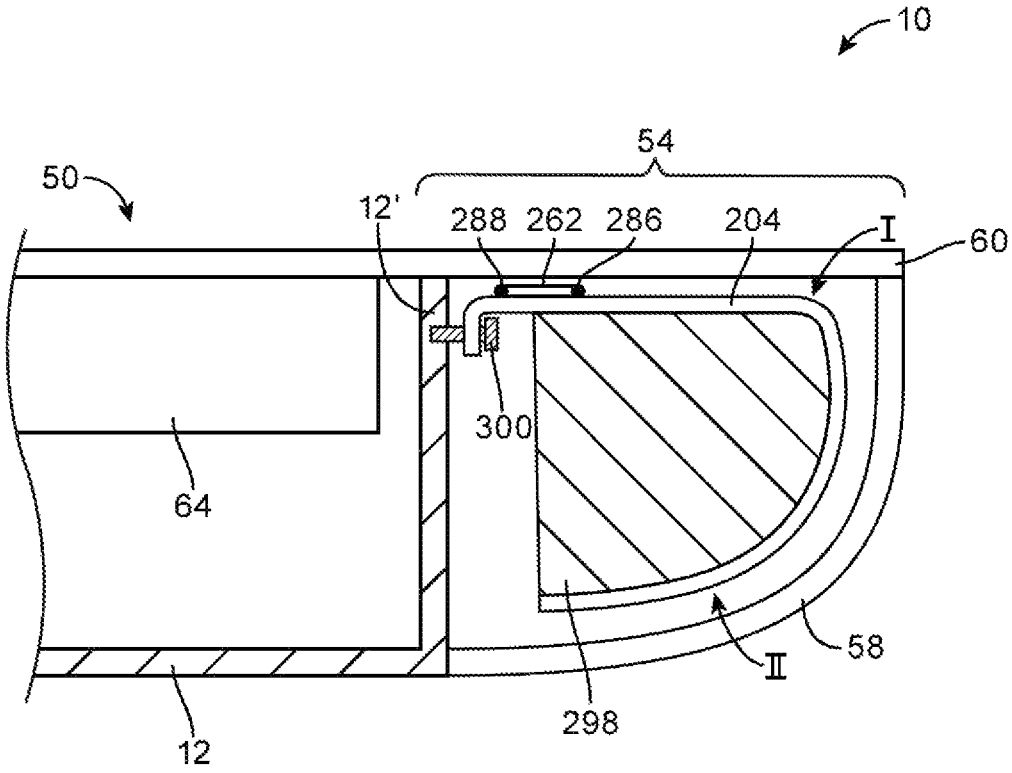
FIG. 14 is a cross-sectional side view of an illustrative electronic device with an antenna formed from a curved antenna resonating element of the type shown in FIG. 13 in accordance with an embodiment of the present invention.

FIG. 13 shows how capacitor 262 may be coupled to edge 296 of antenna structures 204 (i.e., the edge of metal trace 256 that includes positive antenna feed terminal 218 and short circuit path 270). Antenna 204 is curved, so that surface I faces out of the page of FIG. 13 and so that surface II faces into the page of FIG. 13. FIG. 14 is a cross-sectional side view of device 10 showing how terminal 288 of capacitor 262 may be coupled to metal housing portion 12' (e.g., a vertical metal wall that serves as antenna ground 264 and that extends between opposing front and rear surfaces of device 10) via an electrical connection structure such as screw 300. Antenna 204 may be mounted on a dielectric support such as plastic support structure 298 so that surface I of antenna 204 lies under inactive region 54 of display cover layer 60 and faces inactive region 54 of display cover layer 60 and so that surface II of antenna 204 faces antenna window 58.

Figure 15:
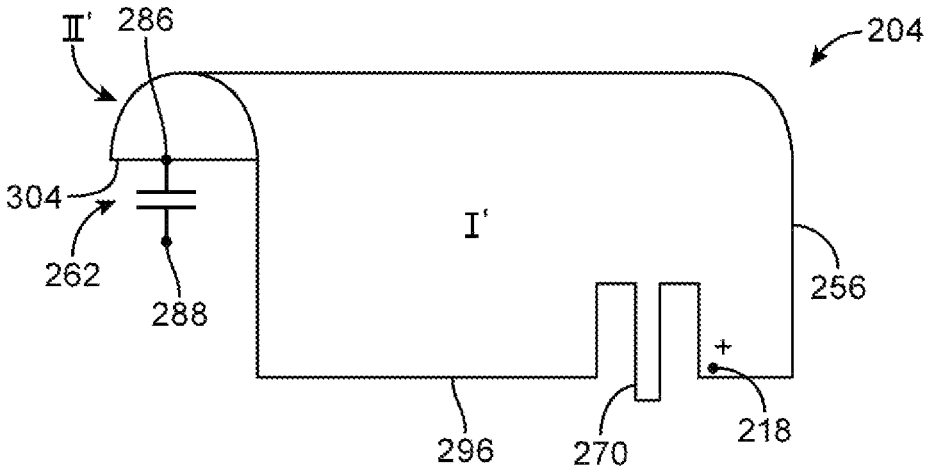
FIG. 15 is a perspective view of another illustrative capacitively loaded inverted-F antenna resonating element formed in a curved shape in accordance with an embodiment of the present invention.
Figure 16:
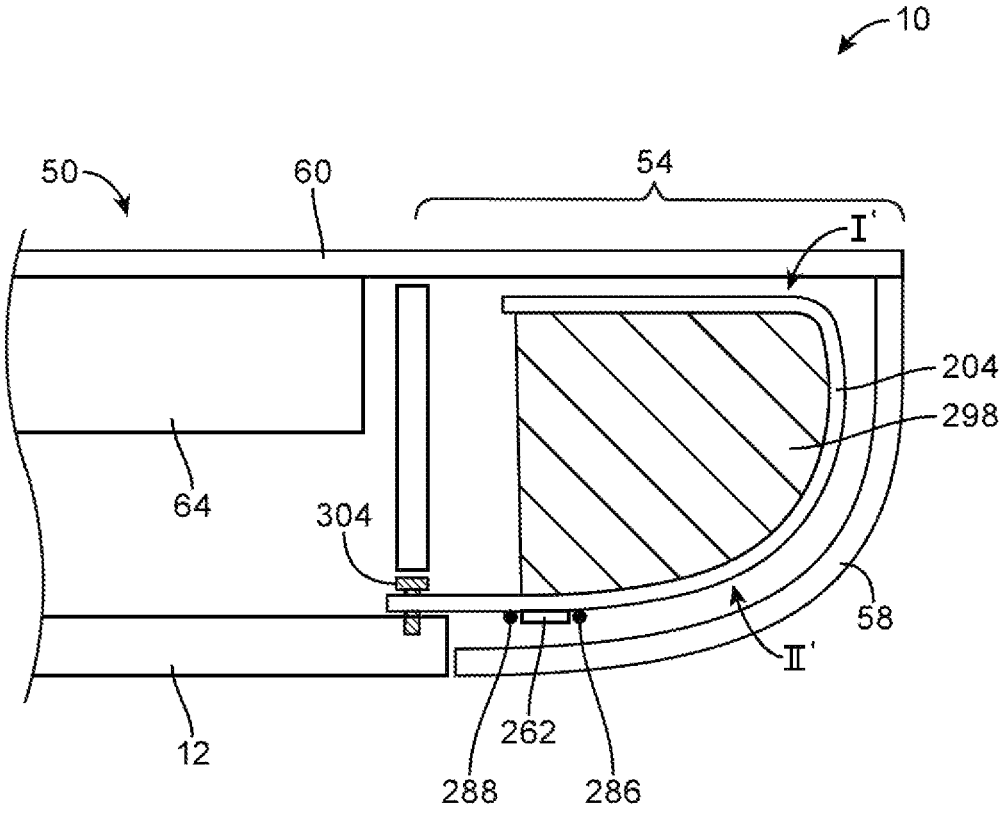
FIG. 16 is a cross-sectional side view of an illustrative electronic device with an antenna formed from a curved antenna resonating element of the type shown in FIG. 15 in accordance with an embodiment of the present invention.

FIG. 15 shows how capacitor 262 may be coupled to edge 304 of antenna structures 204 (i.e., the edge of metal trace 256 opposing edge 296 that includes positive antenna feed terminal 218 and short circuit path 270). Antenna 204 is curved, so that surface I' faces out of the page of FIG. 15 and so that surface II' faces into the page of FIG. 15. FIG. 16 is a cross-sectional side view of device 10 showing how terminal 288 of capacitor 262 may be coupled to metal housing portion 12 (which may serve as antenna ground 264) using an electrical connection structure such as screw 304. Antenna 204 may be mounted on a dielectric support such as plastic support structure 298 so that surface I' of antenna 204 faces inactive region 54 of display cover layer 60 and so that surface II' of antenna 204 faces antenna window 58.

If desired, other types of mounting arrangements may be used for antennas 204 in device 10. The configurations of FIGS. 13, 14, 15, and 16 in which antenna 204 is curved to fit within the curved edge portion of housing 12 and device 10 is merely illustrative.

The foregoing is merely illustrative of the principles of this invention and various modifications can be made by those skilled in the art without departing from the scope and spirit of the invention.

What is claimed is:

1. An antenna, comprising:

an inverted-F antenna resonating element; and an antenna ground;

an antenna feed coupled between the inverted-F antenna resonating element and the antenna ground at one end of the inverted-F antenna resonating element; and a capacitor that is coupled between the inverted-F antenna resonating element and the antenna ground at an opposing end of the inverted-F antenna resonating element, wherein the inverted-F antenna resonating element is formed from a metal trace without a meandering path, the capacitor comprises interdigitated metal fingers, and the interdigitated metal fingers include at least part of the metal trace.

2. The antenna defined in claim 1 wherein the inverted-F antenna resonating element has a curved surface.

3. The antenna defined in claim 1 wherein the capacitor comprises an adjustable capacitor.

4. The antenna defined in claim 3 wherein the adjustable capacitor comprises a plurality of capacitors and corresponding switches, wherein the adjustable capacitor has a first terminal coupled to the metal trace and has a second terminal coupled to the antenna ground, and wherein the capacitors and switches are coupled between the first and second terminals.

5. The antenna defined in claim 1 further comprising a short circuit path that is coupled between the antenna resonating element and the antenna ground at a location between the antenna feed and the capacitor.

6. An electronic device, comprising:

a housing;

a display mounted in the housing, wherein the display has a display cover layer;

a dielectric portion of the housing; and a capacitively loaded inverted-F antenna having an antenna resonating element, an antenna ground, and a capacitor coupled between the antenna resonating element and the antenna ground, wherein the capacitively loaded inverted-F antenna has a curved shape with a first region that faces the display cover layer and a second region that faces the dielectric portion of the housing, the antenna resonating element has a first edge adjacent to the first region and a second edge adjacent to the second region, the capacitor is coupled between the first edge and a portion of the housing that serves as the antenna ground, and the portion of the housing comprises a vertical metal wall that extends between opposing front and rear surfaces of the electronic device.

7. The electronic device defined in claim 6 wherein the antenna resonating element has an inverted-F antenna resonating element arm formed without a meandering path.

8. The electronic device defined in claim 7 wherein the capacitor comprises interdigitated fingers formed at least partly from the antenna resonating element.

9. The electronic device defined in claim 7 wherein the capacitor comprises an adjustable capacitor configured to exhibit at least first and second capacitance values.

10. The electronic device defined in claim 7 further comprising proximity sensor circuitry coupled to the inverted-F antenna resonating element arm.

11. An electronic device, comprising:

a capacitively loaded inverted-F antenna having an inverted-F antenna resonating element, an antenna ground, and a capacitor coupled between the inverted-F antenna resonating element and the antenna ground;

a display module;

a display cover layer that covers the display module;

a metal housing that forms at least part of the antenna ground; and a dielectric antenna window in the metal housing, wherein the capacitively loaded inverted-F antenna is mounted adjacent to the dielectric antenna window, the capacitively loaded inverted-F antenna has a curved shape with a first region that faces the display cover layer and a second region that faces the dielectric antenna window, the inverted-F antenna resonating element has a first edge adjacent to the first region and a second edge adjacent to the second region, and the capacitor is coupled between the second edge and a portion of the metal housing that serves as the antenna ground.

12. The electronic device defined in claim 11 wherein the capacitor comprises an adjustable capacitor that is adjusted to tune the capacitively loaded inverted-F antenna.

13. The electronic device defined in claim 12 wherein the display cover layer has an inactive area that is uncovered by the display module, the electronic device further comprising:

a layer of opaque masking material in the inactive area, wherein the inverted-F antenna resonating element is mounted adjacent to the layer of opaque masking material; and a screw that electrically couples the capacitor to the portion of the metal housing that serves as the antenna ground.

14. The electronic device defined in claim 11, wherein the display module is mounted on a front surface of the metal housing and the portion of the metal housing comprises a metal rear surface of the metal housing.

* * * * *